US005564344A

United States Patent [19]

Downes, Jr. et al.

[11] Patent Number: 5,564,344

[45] Date of Patent: Oct. 15, 1996

[54] TRANSPORTABLE PALLET

[76] Inventors: James G. Downes, Jr.; Brian O. Downes, both of 183 Kemp St., Groton, Mass. 01450

[21] Appl. No.: 534,350

[22] Filed: Sep. 27, 1995

Related U.S. Application Data

[63] Continuation of Ser. No. 93,005, Jul. 19, 1993, abandoned.

[51] Int. Cl.[6] ..... B65D 19/00

[52] U.S. Cl. ..... 108/563; 108/51.1

[58] Field of Search ..... 108/51.1, 51.3, 108/55.3, 57.1

[56] References Cited

U.S. PATENT DOCUMENTS

| | | | |
|---|---|---|---|
| 1,897,598 | 2/1933 | Wyman | 108/55.3 |
| 2,728,545 | 12/1955 | Hermitage | 248/120 |
| 3,477,631 | 11/1969 | Dunlap et al. | 108/55.1 |
| 3,683,822 | 8/1972 | Roberts et al. | 108/51-58 |
| 4,831,938 | 5/1989 | Atterby et al. | 108/51.3 |
| 4,875,419 | 10/1989 | Helton et al. | 108/56.1 |
| 5,001,991 | 3/1991 | Smith | 108/51.3 |
| 5,086,927 | 2/1992 | Bach | 108/55.3 |
| 5,129,329 | 7/1992 | Clasen | 108/51.3 |
| 5,156,094 | 10/1992 | Johansson et al. | 108/51.3 |
| 5,269,219 | 12/1993 | Juvik-Woods | 108/51.3 |

*Primary Examiner*—Peter M. Cuomo
*Assistant Examiner*—Gerald A. Anderson
*Attorney, Agent, or Firm*—Henry S. Miller

[57] ABSTRACT

A transportable pallet runner for moving and storing light to moderate loads comprising a plurality of spaced runners of bonded corrugated cardboard having flutes parallel to the force of the load and a spacer panel affixed to the runners to secure their spacing and orientation. Some runners have angles at their ends to facilitate conveyor movement and orientation.

12 Claims, 2 Drawing Sheets

TRANSPORTABLE PALLET

This application is a continuation of U.S. patent application Ser. No. 08/093,005, filed Jul. 19, 1993, now abandoned.

FIELD OF THE INVENTION

This invention relates generally to a runner for supporting light to medium weight loads and in particular to a runner that is capable of being transported with the load without becoming directly attached to the load.

BACKGROUND OF THE INVENTION

In the world of commerce and industry millions of tons of goods and product are manufactured, shipped and stored on a daily basis. As a practical matter a system and method for moving and storing goods and product has evolved over the years. This system generally utilizes a square or rectangular shaped unit called a pallet which lends strength, stability and uniformity to the load which is placed on the pallet.

It has been suggested that the original pallets were not the product of engineering but rather a practical solution of shippers and handlers who realized it was easier to move a load if there was a convenient method to get their tools under it. The first pallets were simply wooden blocks arranged under a load connected to a slat-like board. With the advent of the forklift the pallet eventually became changed to the wooden block and slat structure we see today on a routine basis.

Several factors are considered in designing and constructing a transportable load beating article. The primary factor of course being the capacity of the article to carry the designed load. Another factor is the unladen weight of the pallet. It must be lightweight so that it might be moved and handled without the necessity of special tools or equipment. Stability is another requirement of a load bearing device. The design must be such that the load will remain undisturbed even if the pallet is acted on by relatively strong vertical and horizontal forces. These forces include normal and expected forces routinely found in the moving and shipping trade as well as the accidental and abusive forces that occur as well.

The pallet must be capable of withstanding a masonable variety of weather and still maintain its structural integrity.

Since pallets are shipped to and from locations world wide, they are generally considered expendable by manufacturers and shippers and are, therefore, not returned to their point of origin. A system for identifying and shipping pallets would cost prohibitive. In some areas of the world wooden pallets are disassembled and used for firewood or as building materials. In other areas they are simply considered waste and discarded.

Wooden pallets have the specific potential disadvantage of being capable of damaging the surface either of the load or the surface where the pallet is set to rest. This occurs because of the generally rough surface of the wood or the protrusion of nails caused by poor quality workmanship during manufacture. Likewise wooden pallets have the undesirable propensity of absorbing moisture from the atmosphere and when transporting products, such as paper for example, a layer of material must be placed between the load and the paper to avoid moisture damage. Wooden pallets are heavy to pick up, cumbersome to handle and expensive to make. In an effort to overcome the disadvantages of the prior art pallets constructed of other materials such as fiberboard or corrugated cardboard were developed.

As a general rule corrugated cardboard pallets are strong, lightweight and easily disposed of or recycled. Pallets of corrugated paper are known in the art and have been commercially available for a number of years. A review of the following U.S. Pat. Nos. would establish their place in the world of commerce and industry. U.S. Pat. Nos.

2,728,545 issued to Hermitage on Dec. 27, 1955

3,683,822 issued to Roberts et al on Aug. 15, 1972

4,831,938 issued to Atterlay et al on May 23, 1989

4,875,419 issued to Helton et al on Oct. 24, 1984

5,001,991 issued to Smith on Mar. 26, 1991

5,129,329 issued to Clasen on Jul. 14, 1992

The pallet formed of corrugated cardboard has, as a general rule, copied the basic size, shape and design of the wooden pallet. The corrugated pallet exhibits a pronounced advantage over wood in its strength-to-weight ratio. The cardboard being 4 to 5 times lighter than its wooden counterpart. The corrugated pallet cost is only a fraction of the wooden pallet cost. In addition the surface of the cardboard pallet is smoother, finer, and without staples or nails to damage any load or storage surface where the pallet might be placed.

Corrugated cardboard pallets are generally formed of a number of structural pieces which are constructed by scoring and folding a cardboard blank. The folding usually ends with the structural piece encased in a final wrap of the blank material. The U.S. Patent to Schmidtke U.S. Pat. No. 4,792,325 dated Dec. 20, 1988, is example of a method and apparatus for manufacturing cardboard pallets.

A disadvantage to the existing design of cardboard pallets is that it does not perform well when supporting loads on conveyors. If the conveyor is straight complaints are minimal. However, if a conveyor is curved the cardboard pallet tends to jam, causing time delay and inconvenience. By the same token, many cardboard pallets have no means for lifting if the pallet becomes reoriented on a conveyor. The areas designed for lifting may easily become rotated so that at the end of the conveyor the openings for a forklift, for example, are transverse to the tines of the lift.

These and other objections to the corrugated cardboard pallet have caused the invention of the transporter runner.

SUMMARY OF THE INVENTION

The subject of this invention is a transporter runner, which is designed to replace wood and cardboard pallets in the majority of applications where pallets of wood or cardboard construction might otherwise be appropriate.

The transporter runner is not a pallet but rather a substitute for the pallet. Constructed of corrugated cardboard, it is of unusually simple design, inexpensive to manufacture, light in weight and easy to handle. These features constitute objects of the invention. In addition the transporter runner is strong, having a load carrying capacity that matches or surpasses that of pallets currently available. The runner is unusually stable and resists shock forces including normal, excessive and abusive from all directions.

A particularly novel feature of the runner is the angle cut at each end of outboard runners. This angle allows a loaded transporter system to flow along a curved conveyor system and at the end of its run the runners of the system are turned for perfect alignment with the forks of a forklift truck.

The transporter runner system is characterized by a spacer panel formed of corrugated cardboard that may be square, rectangular or circular dependent upon the job application. Attached to the appropriately shaped spacer are a plurality of transporter runners. The number of runners will be dependent upon the weight to be supported. The runners are constructed of multiple layers of corrugated cardboard having their flutes parallel to the force of the weight produced by the load. The runners are mounted on one side of the spacer panel approximately one inch in from the edge of the spacer at their closest point. The runners are mounted in such a manner that the flutes of the spacer are transverse to the longitudinal axis of the runners.

The runners are fabricated from a plurality of corrugated pieces, attached by adhesive and allowed to dry naturally without the application of heat and held in a manner that will produce a runner true and aligned in all aspects.

The runners are attached to the spacer by an adhesive that is allowed to run along the length of the flute in the runner adding strength and moisture resistant qualities to the runner.

Other than the spacer the transporter runner system has no other connection between the individual runners. The stability of the system is achieved by the height to width ratio of the individual runners and the construction of the runners without the scoring and folding method used in the construction of existing corrugated cardboard pallets. The advantage gained by allowing an overhand of the spacer is that it allows a load to be wrapped with shrinkable material which maybe brought over the edge of the spacing platform thereby insuring the stability of the load on the transporter runner system.

The system of the invention, when having reached the end of its usefulness, may be disposed of by recycling or cutting the spacer platform between the runners and disposed of in a conventional manner.

BRIEF DESCRIPTION OF THE DRAWINGS

The invention will be described below with reference to the accompanying drawings, in which.

DESCRIPTION OF THE PREFERRED EMBODIMENT

Figure 1:
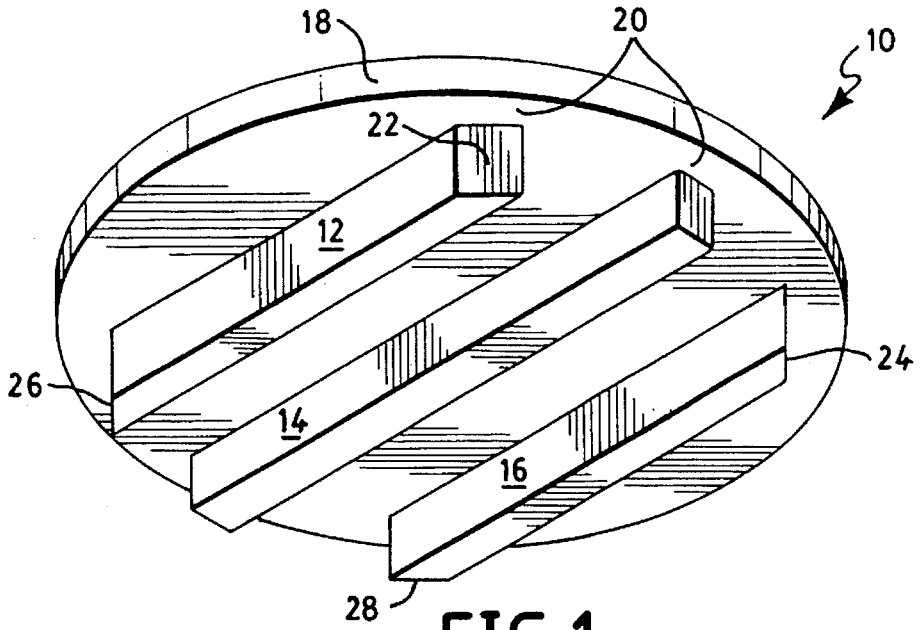
FIG. 1 is a perspective view of the transporter runner embodying the present invention.

Referring now to FIG. 1, the transporter runner of the invention is shown generally at 10. Runners 12, 14 and 16 are affixed to spacer 18 by an adhesive as will be explained hereinafter.

The runners are spaced to provide as near equal weight distribution of the load as possible. The runners as shown and contemplated by the invention are set inboard (20) of the edge of the spacer panel. This novel feature allows the load to be secured to the runner, as for example by surrounding it with a shrinkable plastic material including the edge of the spacer panel.

Runners 12 and 16 are shown with angled ends 22, 24, 26, 28. This angle of 58° allows the runners to traverse curved conveyors without becoming jammed as they move along. In addition the runners are always kept in proper alignment with the sides of the conveyor so that when the load reaches the end of its journey along the conveyor the runners are positioned with an open face toward the arms of a fork type lifting machine.

Figure 2:
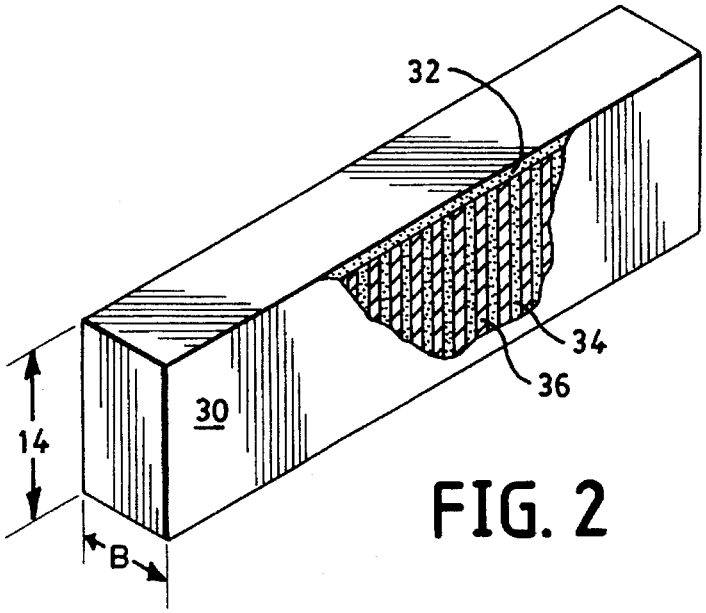
FIG. 2 is a perspective view of a typical runner of the invention partly in cutaway.

FIG. 2 shows a typical runner 30. The runner is formed of double walled corrugated cardboard having vertical load bearing flutes.

The runners are formed by stacking a number of large sheets of corrugated cardboard. The number dependent upon the load bearing requirement of the runner. Between each sheet of cardboard is a layer of adhesive.

After the stack is cured for the appropriate time it is cut into the desired length, width and angle with a precision saw, giving the runner flat surfaces on all sides. Cutting avoids the problems of scoring and folding which produce irregular surfaces and would effect the stability of the runner.

Figure 3:
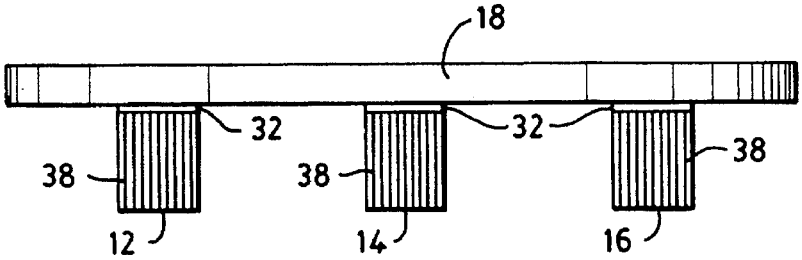
FIG. 3 is a view of the invention showing the runners and spacer members.

FIG. 3 is an end view of the invention showing spacer panel 18 affected to runners 12, 14 and 16. The runners are shown as a composite of corrugated panels 38 having flutes oriented in the direction of the which in normal use is vertical. However, it should be noted that the runner would function equally as well in a horizontal plane.

Figure 4:
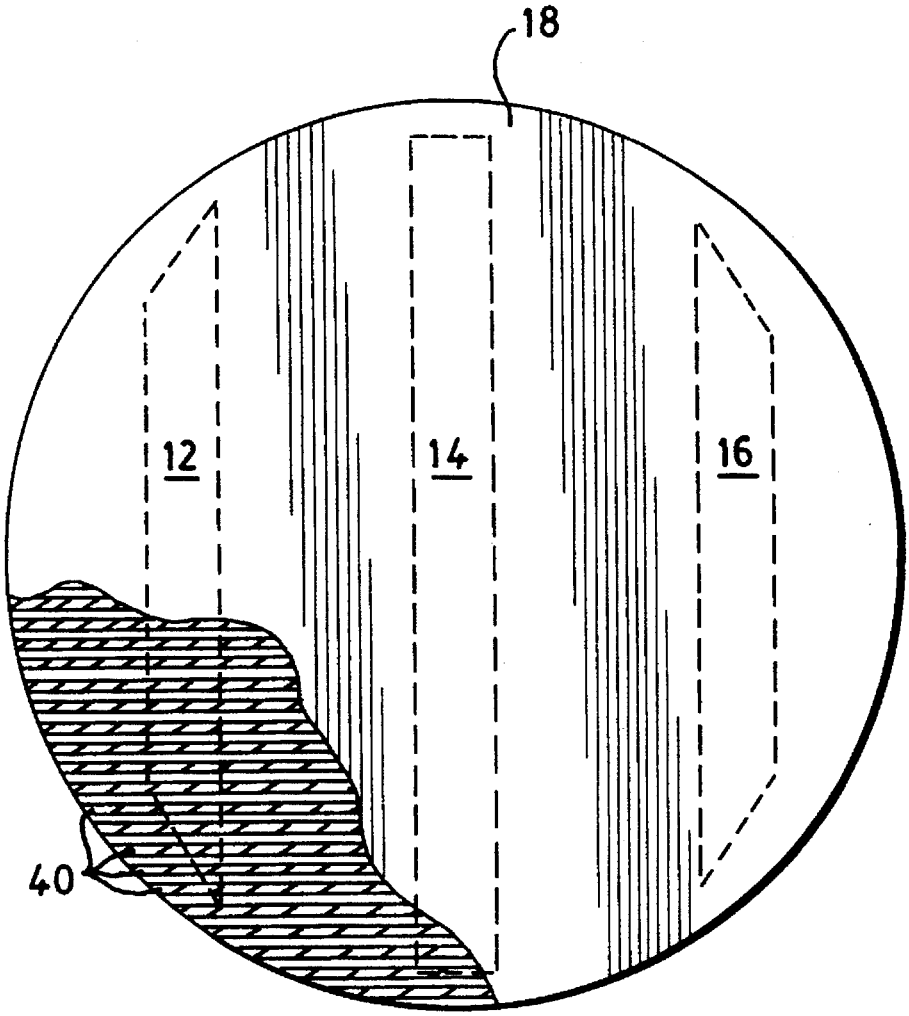
FIG. 4 is a top view of the invention partly in cutaway.

Concerning FIG. 4, spacer panel 18 is shown from the top with runners 12, 14 and 16 correctly oriented on the underside. The flutes 40 of the spacer panel which is also formed of corrugated cardboard are oriented transverse to the longitudinal axis of the runners. This feature adds to the stability of the transporter runner platform.

The runners may be spaced as required on the spacer panel. The number of runners is based upon the capacity required for a specific load. Also the spacer panel shape may be varied in accordance with the load requirements.

The transporter runner shown and described is generally utilized for moving rolls of paper along a manufacturing conveyor, then storing in stacks with the runners supporting in excess of 3000 pounds.

Although the invention has been described with reference to particular embodiments, it will be understood to those skilled in the art that the invention is capable of a variety of alternative embodiments within the spirit of the appended claims.

We claim:

1. A transportable pallet comprising:

a load supporting corrugated cardboard panel having a top and bottom wall separated by a paper forming a plurality of oriented parallel flutes;

a plurality of runners attached in parallel planes to the bottom wall of the load supporting panel by adhesive means;

each runner having a length, width and height dimension, where the length dimension is substantially greater than the width or height dimension;

each runner comprised of a plurality of double wall corrugated cardboard members having outside walls separated by a paper forming a plurality of flutes, where each of said plurality of outside walls is entirely covered with adhesive means and bonded to the next covered outside wall, and where the flutes of each runner are oriented in a plane perpendicular to the plane of the load supporting panel, and the longitudinal axis of each runner is positioned transverse to the axis of the flutes contained in the load supporting panel.

2. A transportable pallet according to claim 1 wherein:

the ends of the runner are formed at an angle to the longitudinal axis of the runner.

3. A transportable pallet according to claim 2 wherein:

the angle formed between the longitudinal axis of the runner and the end of the runner is 58 degrees.

4. A transportable pallet according to claim 3 wherein:

the adhesive is formed of a mixture of water, cornstarch and latex.

5. A transportable pallet according to claim 4 wherein:

the flutes of each corrugated cardboard layer forming the runner contains some adhesive.

6. A transportable pallet according to claim 5 wherein:

the flutes of each corrugated cardboard layer forming the runner are filled with adhesive.

7. The transporter runner according to claim 1 wherein the load supporting and includes a circumference entire edge panel is circular.

8. The transporter runner according to claim 1 wherein the load supporting panel is rectilinear, and includes an edge around the perimeter.

9. The transporter runner according to claim 6 wherein the cross-sectional dimensions of the runner are in a ratio of 4 to 3.

10. The transporter runner according to claim 9 wherein the runners are positioned on the spacer panel away from the circumferential or edge perimeter of said panel.

11. The transporter runner according to claim 2 wherein the angle formed between the longitudinal axis of the runner and the end of the runner is less than ninety degrees.

12. The transporter runner according to claim 2 wherein the angle formed between the longitudinal axis of the runner and the end of the runner is ninety degrees.

* * * * *

UNITED STATES PATENT AND TRADEMARK OFFICE

CERTIFICATE OF CORRECTION

PATENT NO : 5,564,344

DATED : Oct. 15, 1996

INVENTOR(S) : Downes, Jr. et al.

It is certified that error appears in the above-identified patent and that said Letters Patent is hereby corrected as shown below:

In column 5, lines 13 and 14 after "supporting", cancel "and includes a circumference entire edge panel is circular." and insert after "supporting" --panel is circular, and includes a circumferential edge.--

Signed and Sealed this

Ninth Day of June, 1998

*Attest:*

*Attesting Officer*

Bruce Lehman

BRUCE LEHMAN

*Commissioner of Patents and Trademarks*